US005654690A

United States Patent [19]

Ishikawa et al.

[11] Patent Number: 5,654,690

[45] Date of Patent: Aug. 5, 1997

[54] FIRE ALARM SYSTEM

[75] Inventors: Seiko Ishikawa, Aichi-ken; Takayoshi Urano; Kazunori Ikami, both of Nagoya; Yoshihiko Hibino, Gifu-ken; Masaru Yasuda, Nagoya; Yasuhiro Funahashi, Nagoya; Naomi Moriguchi, Nagoya; Hiroshi Matsuhashi, Aichi-ken; Tatsuo Matsuda, Toyama-ken; Kazuhiro Fujii, Toyama-ken, all of Japan

[73] Assignees: Brother Kogyo Kabushiki Kaisha; Xing Inc., both of Aichi-ken; Intec Inc., Toyama-ken, all of Japan

[21] Appl. No.: 354,668

[22] Filed: Dec. 13, 1994

[30] Foreign Application Priority Data

| | | | |
|---|---|---|---|
| Dec. 13, 1993 | [JP] | Japan | 5-311554 |
| Dec. 28, 1993 | [JP] | Japan | 5-350549 |
| Dec. 28, 1993 | [JP] | Japan | 5-350550 |
| Dec. 28, 1993 | [JP] | Japan | 5-350551 |

[51] Int. Cl.[6] ..... G08B 29/00

[52] U.S. Cl. ..... 340/506; 340/531; 340/533; 340/288; 340/825.06; 340/825.24; 340/825.36; 340/825.47; 340/825.52

[58] Field of Search ..... 340/506, 531, 340/532, 533, 287, 288, 825.06, 825.07, 825.24, 825.47, 825.25, 825.36, 825.37, 825.52

[56] References Cited

U.S. PATENT DOCUMENTS

| | | | |
|---|---|---|---|
| 4,389,639 | 6/1983 | Torii et al. | 340/531 |
| 4,673,920 | 6/1987 | Ferguson et al. | 340/531 |
| 5,189,394 | 2/1993 | Walter et al. | 340/506 |
| 5,252,775 | 10/1993 | Urano et al. | 340/506 |

FOREIGN PATENT DOCUMENTS 3239292 10/1991 Japan .

*Primary Examiner*—Brent A. Swarthout
*Assistant Examiner*—Daryl C. Pope
*Attorney, Agent, or Firm*—Kane, Dalsimer, Sullivan, Kurucz, Levy, Eisele and Richard, LLP

[57] ABSTRACT

Disclosed is an improved fire alarm system for an information providing system having a plurality of terminal devices for providing information to a plurality of operators, respectively. The fire alarm system is provided with a fire detecting sensors. If a fire is detected, a predetermined signal is transmitted to a controller. The controller controls each of the plurality of terminal devices to indicate an alarm information to the operator when the predetermined signal is received.

27 Claims, 20 Drawing Sheets

104
COAX CABLE 105
T/R MODEM 132
CONTROLLER 131
MODEM CONTROLER 133
MEMORY 137
TUNER 134
SOUND CONTROLLER 135
DISPLAY CONTROLLER 136
OPERATION PANEL 138
110
FIRE!
109

FIRE ALARM SYSTEM

BACKGROUND OF THE INVENTION

The present invention relates to a fire alarm system used with devices for informing an outbreak of a fire to operators of the devices.

Conventional fire alarm systems use an alarm or siren which is activated by a controller in response to a signal detected by a smoke detector or heat sensor. Further, there may be a manual activation switch which a person presses to activate the alarm. However, if persons in the enclosed environment where the alarm is activated cannot hear the alarm due to other sounds, then the emergency situation will not be recognized and the persons will not realize that they should vacate the enclosed environment.

Recently "karaoke rooms" have become popular. A karaoke room is a soundproof room equipped with a karaoke terminal (a terminal for generating musical accompaniment, i.e., the instrumental part of a song without the voice track, allowing persons to sing the vocal track themselves, an example of which is disclosed in U.S. Pat. No. 5,252,775). Many karaoke rooms may be provided on a single floor of a building. If a fire broke out in one of the karaoke rooms, and an alarm was sounded, the soundproof nature of the karaoke rooms would make it difficult for occupants of the other karaoke rooms to hear the alarm.

Other enclosed environments such as video arcades have also become popular. In video arcades, some of the video games use an interactive helmet or headset which provides audio information to the person when he is playing the video game. If a fire broke out while the person was playing the video game, the person would most likely not hear the alarm. Further, in the crowded environment, if the person heard the alarm, he might not be able to locate the nearest exit because of the crowd.

SUMMARY OF THE INVENTION

It is therefore an object of the present invention to provide a fire alarm system which can alert a person to recognize an emergency condition even when the person's attention is focused on a device and his hearing and vision are isolated from the environment outside the device and himself.

According to one aspect of the present invention, there is provided a fire alarm system for an information providing system comprising: a controller; a plurality of terminal devices connected to the controller, each of the plurality of terminal devices indicating information to an operator in accordance with a signal supplied from the controller; fire detecting means for detecting a fire and outputting a predetermined signal; signal processing means for receiving the predetermined signal from the fire detecting means and transmitting an emergency information signal to the controller, wherein the controller controls each of the plurality of terminal devices to provide an emergency information to the operator in accordance with the emergency information signal.

Optionally, the alarm information includes an indication of a fire. Further, the alarm information may include an indication of a passageway.

Alternatively, the terminal devices are capable of providing audio information. The terminal devices may provide an image information. Optionally, another sense of human being can be used for indicating an operator to recognize the emergency situation.

Optionally, the information providing system is for providing an entertainment information. The information providing system may be applied to various kind of system to which an operator's attention should be paid while the operator is operating the terminal device.

The fire detecting means comprises a sensor for detecting a fire and/or a manually operable member.

According to another aspect of the invention, there is provided a fire alarm system for an information providing system comprising: a controller; a plurality of terminal devices connected to the controller, at least one of the terminal devices being used in an enclosed environment where a sense of an operator is concentrated on the at least one of the terminal devices, and each of the plurality of terminal devices indicating information to an operator in accordance with a signal supplied from the controller; fire detecting means for detecting a fire and outputting a predetermined signal; and signal processing means for receiving the predetermined signal from the fire detecting means and transmitting a an emergency information signal to the controller, wherein the controller controls each of the plurality of terminal devices to provide emergency information to the operator in accordance with the emergency information signal.

According to further aspect of the invention, there is provided a fire alarm system for an information providing system comprising: a controller; a plurality of terminal devices connected to the controller, each of the plurality of terminal devices indicating information to an operator in accordance with a signal supplied from the controller; fire detecting means for detecting a fire and outputting a predetermined signal; means for receiving the predetermined signal from the fire detecting means and outputting an emergency information signal to the controller, wherein the controller controls each of the plurality of terminal devices to stop normal information providing operation and provide an emergency information to the operator in accordance with the emergency information signal.

Optionally, the alarm information can be provided to the operator by means of one of five senses of human being. Preferably, audio and/or video information should be used.

Preferably, the fire alarm system further may have means for indicating emergency-cleared condition to the controller, wherein the controller controls the terminal devices to stop indicating the alarm information when the controller received indication of the emergency-cleared condition.

Optionally, the controller controls the terminal devices to provide message indicating the emergency-cleared condition.

Further optionally, the controller may control the terminal devices to start providing the normal information providing operation after the controller received the emergency-cleared-condition indication.

The normal information providing operation may be automatically started after the controller received the emergency-cleared-condition indication.

Alternatively, the normal information providing operation is started when the operator executes a predetermined operation, e.g., depresses a predetermined key provided on the terminal device.

Preferably, the controller may have a memory for storing operation condition information of each of the terminal devices when the controller received the second predetermined signal, the operation condition information is stored in the memory is used for starting the normal information providing operation after the controller received the emergency-cleared-condition indication.

According to still further aspect of the invention, there is provided a fire alarm system for an information providing system comprising: a controller; a plurality of terminal devices connected to the controller, each of the plurality of terminal devices indicating information to an operator in accordance with a signal supplied from the controller; fire detecting means for detecting a fire and outputting a predetermined signal; means for receiving the predetermined signal and outputting and emergency information signal to the controller, wherein the controller controls each of the plurality of terminal devices to provide emergency information to the operator, and wherein each of the terminal devices is capable of providing different emergency information.

Optionally, each of the terminal devices comprises a memory for storing the alarm information intrinsic to the each of the terminal devices.

Further optionally, the terminal devices may have displaying means, and the alarm information includes an image information to be displayed on the displaying means.

Preferably, the image information includes a map showing an exit.

Further optionally, the second predetermined signal carries an information related to the location of a detecting means which detected the fire, and wherein each of the terminal devices displays an optimum passageway from the each of the terminal devices to the exit based on the information related to the location of the fire.

DESCRIPTION OF THE EMBODIMENTS

Figure 1:
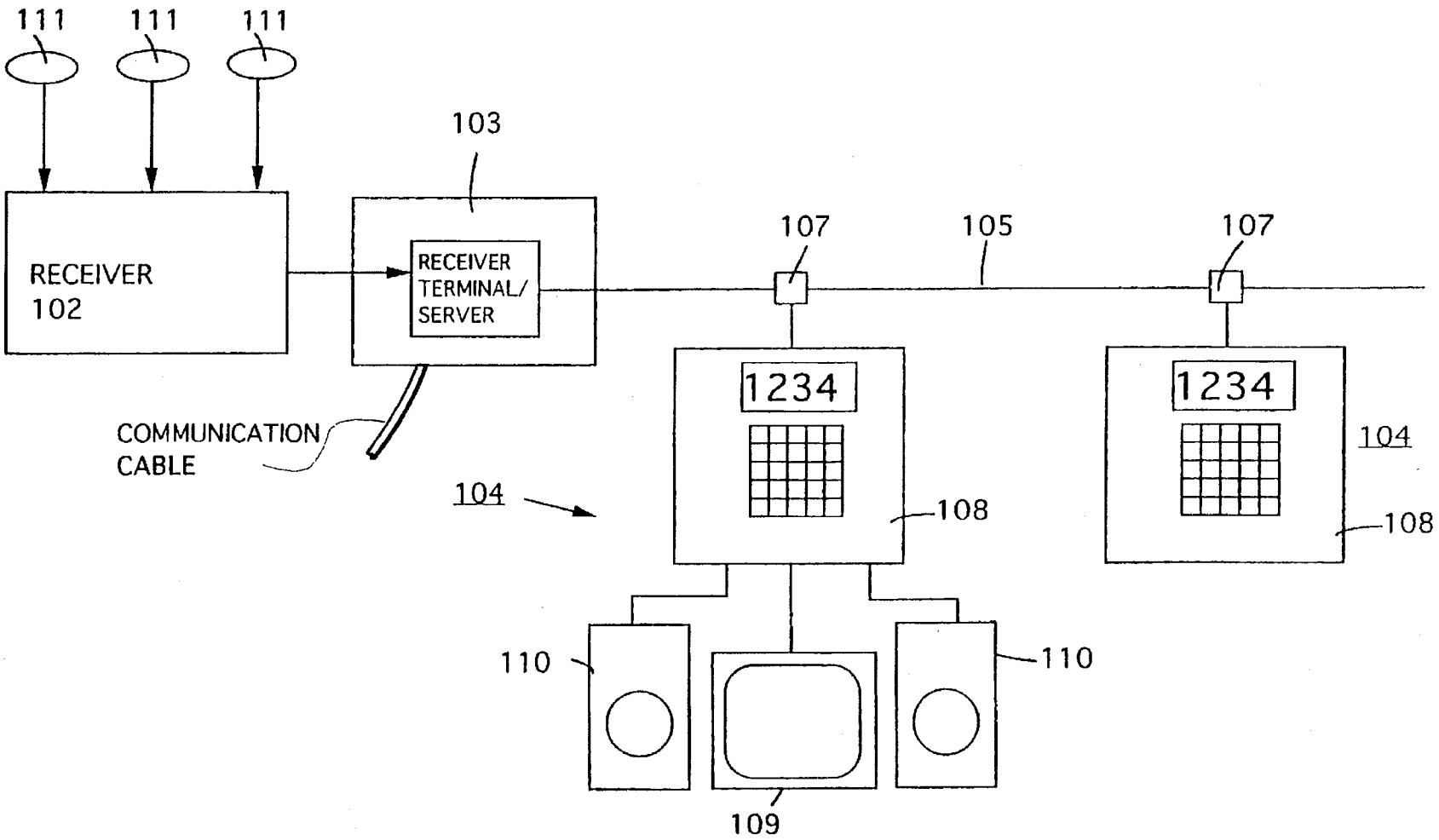
FIG. 1 shows a fire alarm system according to a first embodiment of the present invention.

FIG. 1 shows a configuration of a first embodiment of a fire alarm system which is employed in a karaoke system.

The fire alarm system consists of a plurality of sensors 111, and a receiver 102 for receiving a signal output by the sensors 111. The sensors 111 are thermosensors which detect the ambient temperature of the air. If an unusual increase in temperature is detected, the sensors 111 output a predetermined alarm actuation signal to the receiver 102. The sensors 111 can also include smoke detectors for detecting smoke.

An output of the receiver 102 is fed to an input of a controller 103. The controller 103 has the functions of a server and a receiver terminal, and controls the karaoke system by sending data to each of the karaoke terminals 104 through coaxial cable 105 and patch units 107. Data sent from the controller 103 includes audio and video data which is processed by control box 108 of the karaoke terminal 104, and output to the display 109 and speakers 110.

Figure 2:
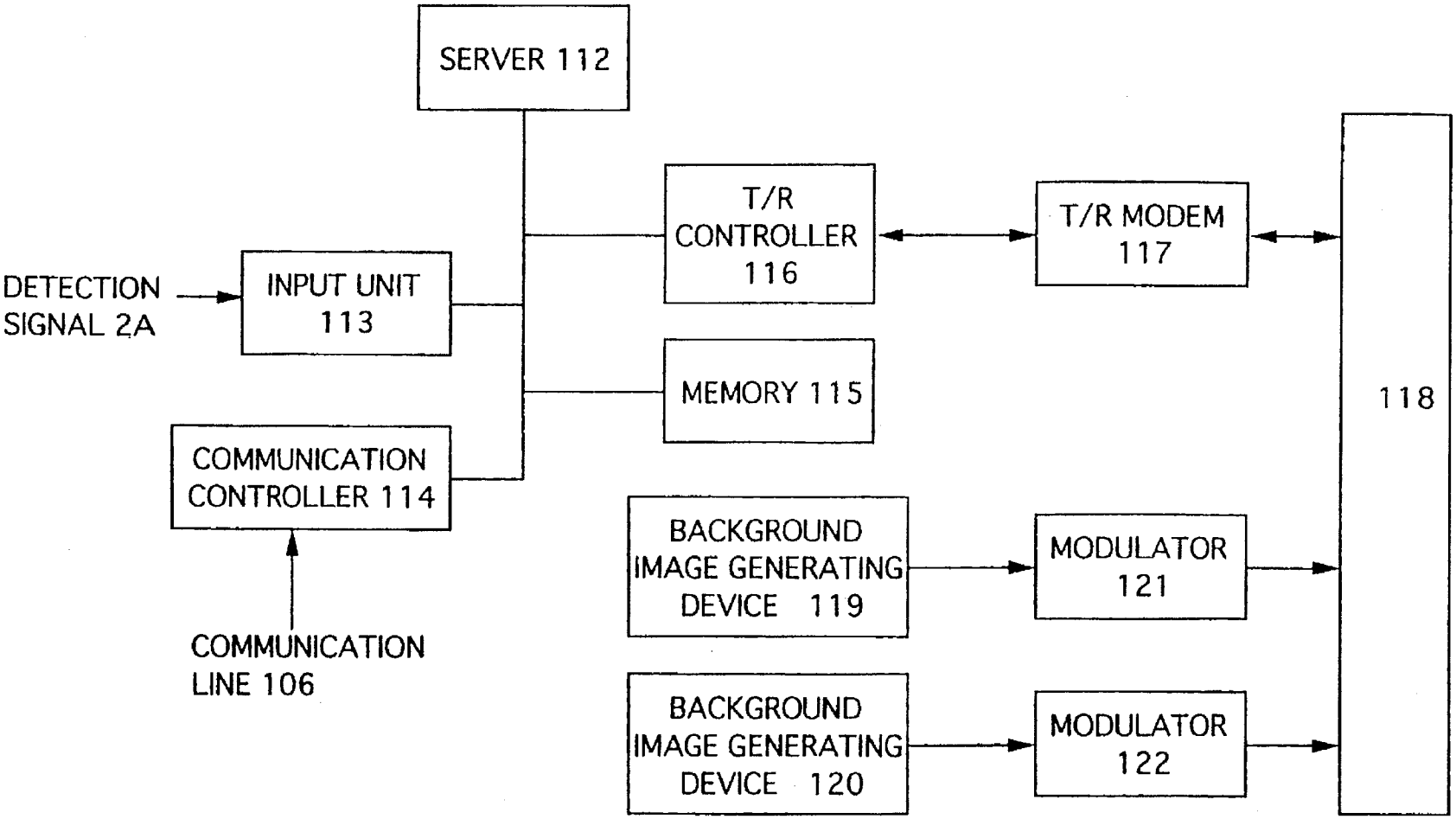
FIG. 2 shows components of a controller used in the fire alarm system shown in FIG. 1.

FIG. 2 shows a block diagram of the controller 103. The controller 103 has a server 112 which supplies a plurality of audio/video data as well as emergency data in case a fire or other emergency is detected. Detection signal 2A output by the receiver 102 is processed by input unit 113 and sent to the server 112. The communication line 106 is also connected to the server through the communication controller 114. A memory 115 and a transmission/reception controller are also connected to the server 112. The memory 115 includes a ROM which stores a control program of the controller 103 and RAMs for storing various data required to operate the karaoke system.

The memory 115 further includes a hard disk drive which stores music data in the form of MIDI (Musical Instrument Digital Interface) data. This MIDI data is transmitted to the karaoke terminals 104 which generate music based on the MIDI data. The modem 117 transmits the digital MIDI data to karaoke terminal 104 and receives data from the karaoke terminal 104 through the output terminal 118.

The controller 103 also has first and second background image generating devices 119 and 120. Each background image generating device 119, 120 has a laser disk player, which provides the background video data that is displayed on monitor 109 of the karaoke terminal 104. The video data is sent from the background image generating devices 119, 120 to modulators 121 and 122, respectively, and then sent to output terminal 118.

Figure 3:
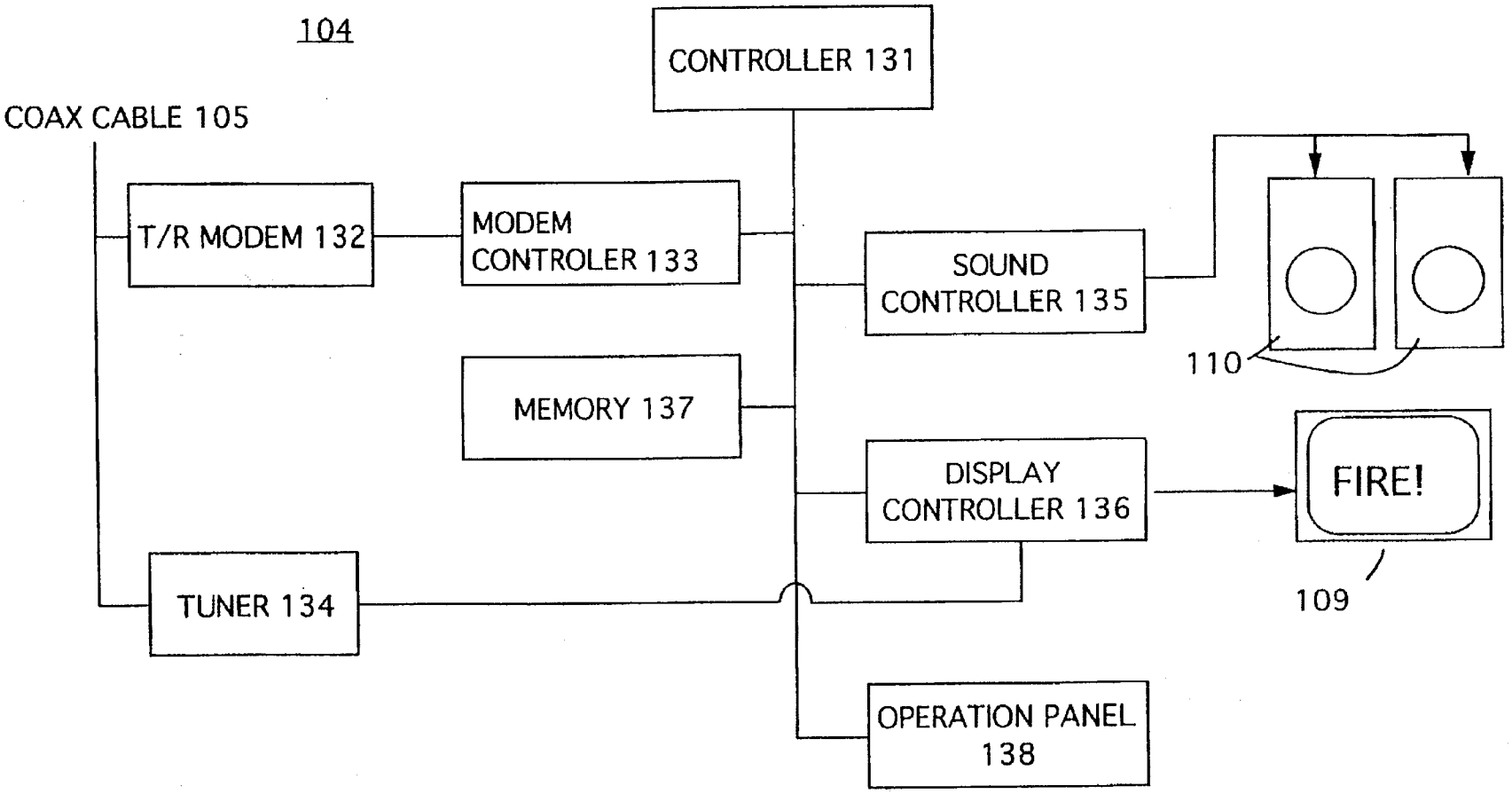
FIG. 3 shows components of a karaoke terminal used with the fire alarm system shown in FIG. 1.

FIG. 3 shows a configuration of one of the karaoke terminals 104, and more specifically the control box 108.

The control box 108 receives data from the coaxial cable 105 through modem 132 and tuner 134. The digital data, including the MIDI data, is received through the modem 132 and modem controller 133 and fed to the memory 137 and sound controller 135. The video data is demodulated by the tuner 134 and fed to the display controller 136. In this embodiment the tuner 134 demodulates normal analog video data, but another device which decodes compressed digital video data may also be employed.

The memory 137 stores data related to the operation of the karaoke terminal 104, as well as codes corresponding to songs requested by the user of the karaoke terminal 104, and entered using the operation panel 138. A remote control (not shown) may also be used to enter the codes of songs to be requested.

The display controller 136 has a graphic processor capable of generating alphanumeric information supplied from the digital information received from the modem controller 133. This alphanumeric information usually consists of lyrics of the song that was requested by the user, and is superimposed on the video information demodulated by the tuner 134 and displayed on the display 109.

The sound controller 135 generates analog music based on the received MIDI data. The sound is then amplified and fed to the left and right stereo speakers 110.

The operation of the fire alarm system with the karaoke system will be described with reference to FIGS. 4A and 4B.

At step S1, the controller 103 determines whether an emergency has occurred by checking whether the detection signal 2A has been received from the receiver 102. If the detection signal is absent (S1:NO), then the controller 103 determines whether any tunes have been registered (i.e., requested) from the karaoke terminal 104, in step S2.

If tunes have been registered (S2:YES), the code numbers of the registered tunes to be played are stored in a current tune memory portion of the memory 115 of the controller 103. Then in step S4 the audio data corresponding to the tune in the current tune memory is downloaded from the hard disk of the memory 115 and sent to the karaoke terminal 104 through the modem 117 and cable 105. Video data is sent from one of the background image generating devices 119, 120 and modulated and sent to the karaoke terminal through cable 105, to be displayed on the display 109, as described above.

Then at step S5, the controller 103 again determines whether an emergency has occurred by checking whether the detection signal 2A has been received from the receiver 102. If an emergency has not been detected (S5:NO) the controller 103 determines whether the playing of all the requested tunes has been completed, in step S6. If all the tunes requested have been played, control goes to step S1, otherwise control goes to step S5.

In step S5, if an emergency has been detected by the controller 103 (i.e., receiver 102 sends detection signal 2A), the playing of the tune is stopped and control proceeds to the fire alarm processing starting from step S9. Similarly, in step S1, if an emergency is detected, control also proceeds to S8.

The controller 103 sends an emergency indicating signal to the karaoke terminal 104. When the karaoke terminal 104 receives the emergency indicating signal, emergency audio and video information which is stored in memory 137 is fed to the sound controller 135 and display controller 136 for processing. Then an audio message warning of the fire is sent to the speakers 110, in step S9. Simultaneously, a video message warning of the fire is sent to the display 109. This video message may be character information such as the word "FIRE" or some other message that easily informs that there is an emergency situation.

Figure 17:
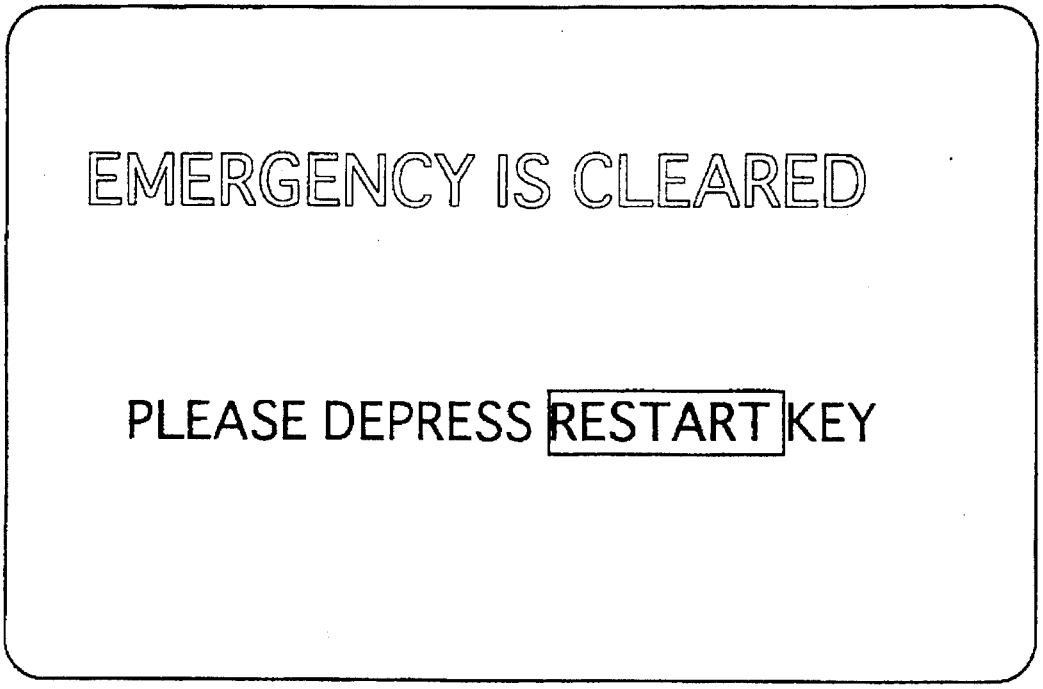
FIG. 17 shows a screen image of a display when an emergency is cleared.

The emergency warning messages are continuously output until the controller 103 determines that the fire has been extinguished or that the emergency has been cleared, in step S10. If the fire has been extinguished, or the emergency was a false alarm, the controller 103 sends an emergency-cleared signal to the karaoke terminal 104 through the modem 117 and cable 105. After receiving the emergency-cleared signal, audio and video information stored in the memory 137 and which contains a message informing that the emergency is over or that the fire has been extinguished, is sent to the speakers 110 and display 109, in step S11. At this stage, on the display 109, a message "Emergency has been cleared. Please depress RESTART key" is displayed as shown in FIG. 17. An audio message may also be provided simultaneously.

Then in step S12, the controller 103 determines whether a reset button or a restart key has been depressed by an operator in order to resume normal operation of the karaoke system. At step S13, the controller determines whether there are any tunes that were requested before the emergency occurred and have not yet been played in accordance with data stored in the memory 137. If there are requested tunes still to be played (S13:YES), control goes to step S4 where the next tune is played. Otherwise control goes to step S1.

As controlled above, even if the emergency occurs while the registered tunes are played sequentially, the data is not erased. Therefore, after the emergency is cleared, playing of the registered tunes is continued without requiring re-registration of the tunes.

As described above, if an emergency occurs, an emergency indicating signal is sent to the karaoke terminal 104 from the controller 103. The karaoke terminal 104 then uses data stored in memory 137 located within the karaoke terminal 104 in order to generate the emergency indicating message. In this case an audio message is sent to the speakers 110 and a video message is sent to the display 109. Since the data is stored in memory 137 which is inside the karaoke terminal, only a simple actuation signal needs to be sent form the controller 103. It is not necessary to have the emergency audio information stored in the hard disk of memory 115, nor is it necessary to have a special laser disk having the visual emergency message in the background image generating devices 119, 120.

It is possible to add another communication line to the controller 103 such that the emergency can be reported to a police station or fire station when the emergency is detected.

In the above embodiment, the karaoke terminal 104 informs that the emergency is cleared when it receives the emergency cleared signal, and then the operator is required to operate the restart key (see steps S11 and S12). The control can be modified such that the steps S11 and S12 are skipped. In this case, the karaoke terminal 104 may start playing without informing the emergency cleared condition or requiring a key operation.

Figure 5:
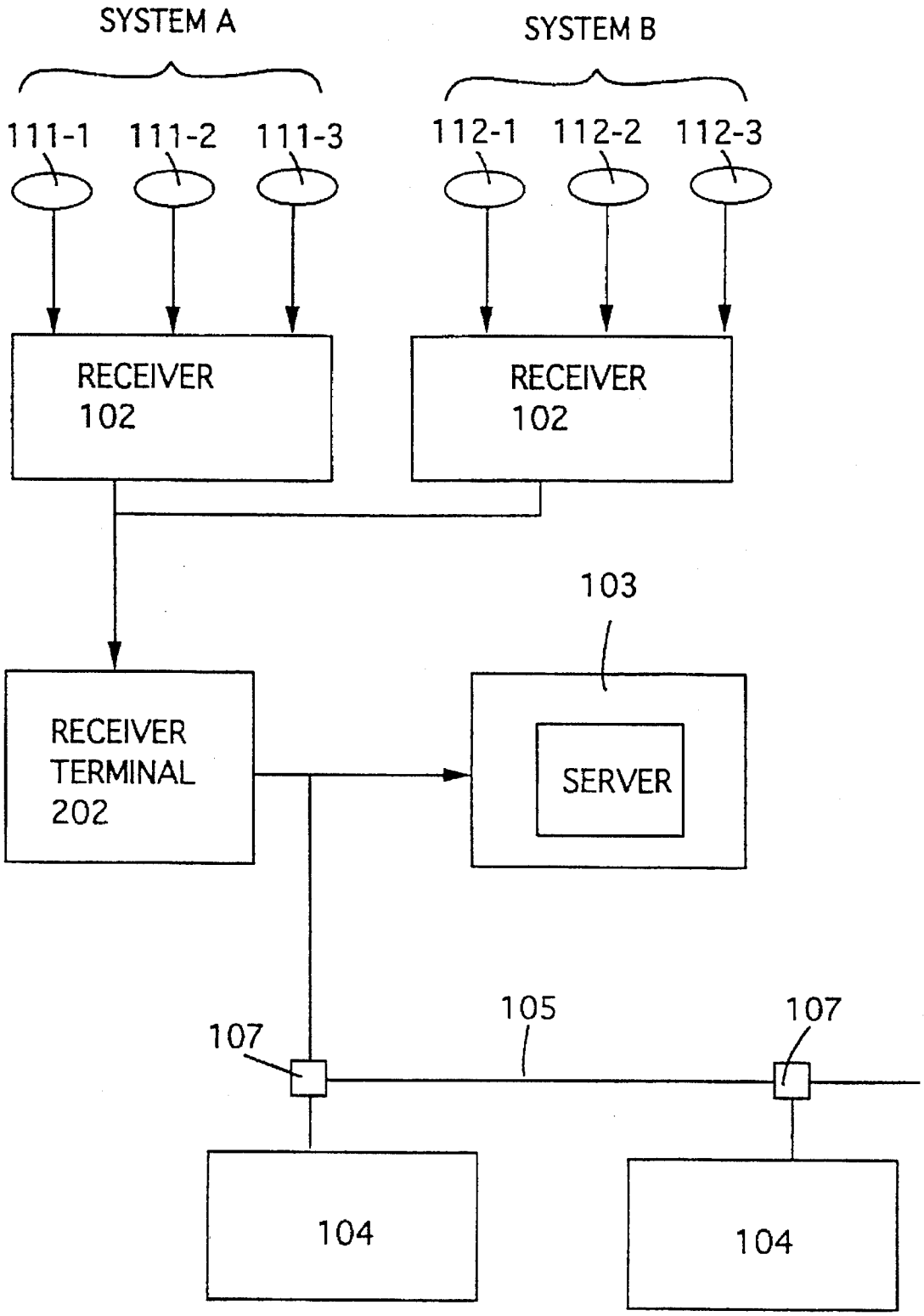
FIG. 5 shows a fire alarm system according to a second embodiment of the present invention.

FIG. 5 shows a fire alarm system according to a second embodiment of the present invention. This second embodiment is similar to the first embodiment shown in FIG. 1 except that receiver terminal 202 is provided between the receivers 102 and controller 103.

The karaoke system is provided with a plurality of systems of fire sensors 111-1, 111-2, . . . , 111-n, 112-1, 112-2, . . . , 112-n for detecting a fire and outputting a detection signal to fire detection signal receivers 102. The sensors 111-1, 111-2, . . . , 111-n belong to a system A, and the sensors 112-1, 112-2, . . . , 112-n belong to a system B, as shown in FIG. 5. A receiver terminal 202 receives the output of the receivers 102. In accordance with data signal output by the receiver terminal 202, a server 103 sends various data signals to each of the karaoke terminals 104 through the patch units 107. The karaoke terminals 104 provide audio and/or video information such as music data and/or messages in accordance with the received data.

The receiver terminal 202 and the server 103 are provided in a central controlling station of the karaoke system. If the sensors 111-1, 111-2, 111-3, . . . , 111-n, 112-1, 112-2, . . . , 112-n detect the fire, the server 103 transmits information indicating emergency condition, and if the emergency is cleared, information indicating that the emergency is cleared is transmitted.

In the karaoke system of FIG. 5, each karaoke terminal 104 plays tunes in accordance with data stored in a memory provided in the karaoke terminal 104, and data transmitted from the server 103. If one of the sensors 111-1, 111-2, . . . , 111-n, 112-1, 112-2, . . . , 112-n detects the fire, the sensor sends a detection signal to one of the receiver 102 to which the sensor belongs. Then the receiver 102 sends a report signal to the receiver terminal 202. Upon reception of the report signal from the receiver 102, the receiver terminal 202 sends an emergency information signal to the karaoke terminals 104 through the server 103. The karaoke terminals 104 temporarily stop playing tunes on reception of the emergency information signal, and display the emergency information. The audio message may also be provided.

After the fire is extinguished, or if the emergency was a false alarm, the receiver terminal 202 sends an emergency cleared signal to the karaoke terminals via the server 103. The karaoke terminals 104 execute an emergency clear operation when the emergency cleared signal is received, and the tune which was being played when the emergency occurred is played again automatically.

With this configuration, the number of sensors 111-1, 111-2, 111-3, . . . , 111-n, 112-1, 112-2, . . . , 112-n that can be used in the fire alarm system is increased. Further, other sensors such as gas detectors for sensing gas leaking from a furnace system can be used.

If the sensors are categorized as above, the controller 103 may control only the karaoke terminals 104 corresponding to a system of the sensors containing the sensor which detected the fire, to output the emergency message and stop the normal operation. The other karaoke terminals 104 will be allowed to continue operating normally.

Figure 6:
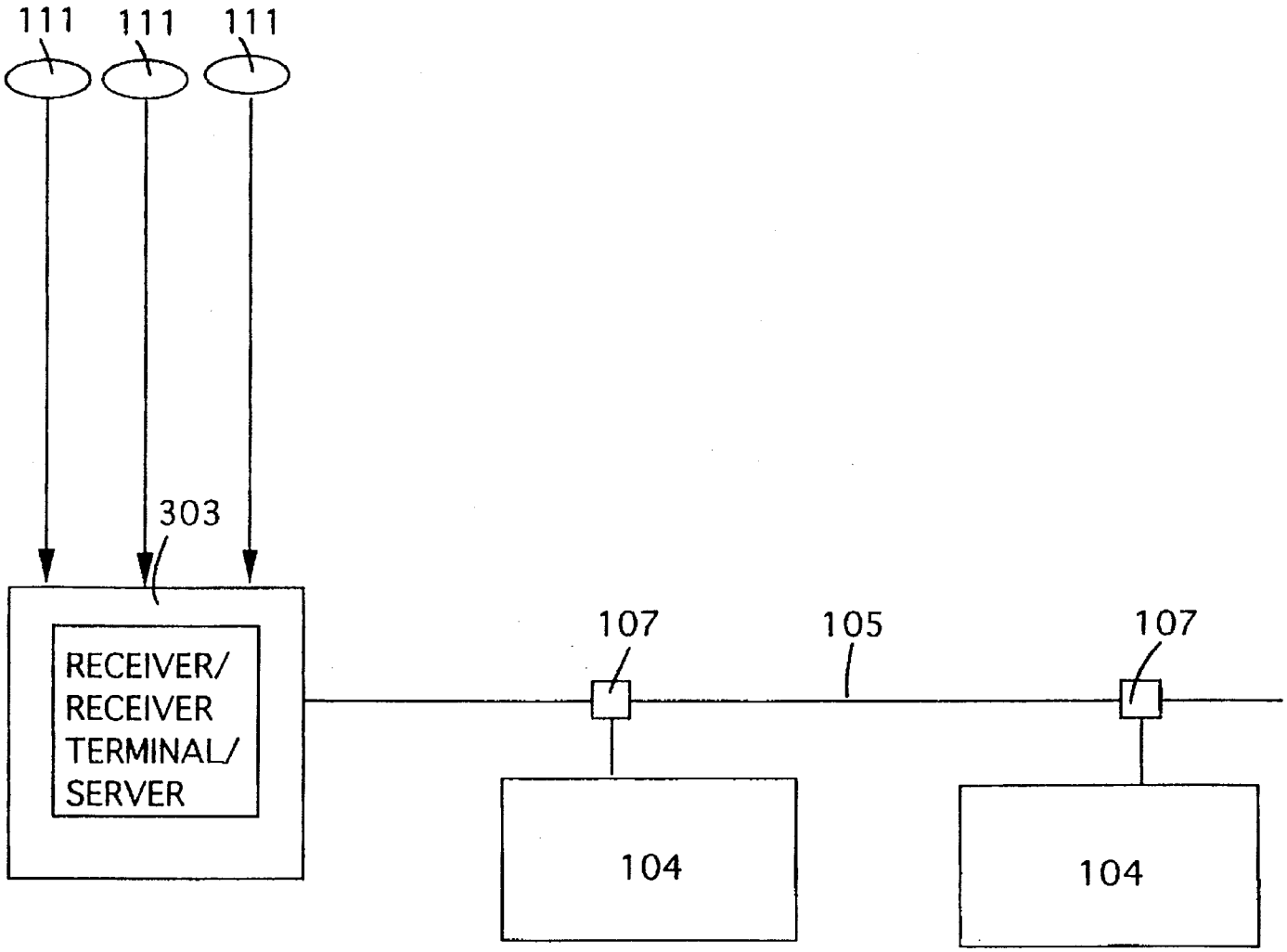
FIG. 6 shows a fire alarm system according to a third embodiment of the present invention.

FIG. 6 shows a fire alarm system according to a third embodiment of the present invention. This third embodiment is similar to the first embodiment shown in FIG. 1, except that controller 303 includes the functions of receiver 102, receiver terminal 202, and server 103. Further, sensors 111 are connected directly to the controller 303. Therefore, when the sensors 111 detect a fire, a signal is sent to the controller 303 to indicate that an emergency has occurred. The controller 303 then processes the received signal and outputs the emergency indicating signal to the karaoke terminal 104, in a similar manner to that described for the first embodiment above. This could be implemented if the number of sensors 111 used is not large. In this way the amount of hardware required to implement the fire alarm system is reduced further.

Since the controller 103 has the functions of receiver terminal and server, the controller 103 of the first embodiment reduces the amount of hardware required to implement the fire alarm system. Since the controller 303 has functions of the receiver, receiver terminal, and server, the controller 303 of the third embodiment further reduces the amount of hardware required to implement the fire alarm system.

Figure 7:
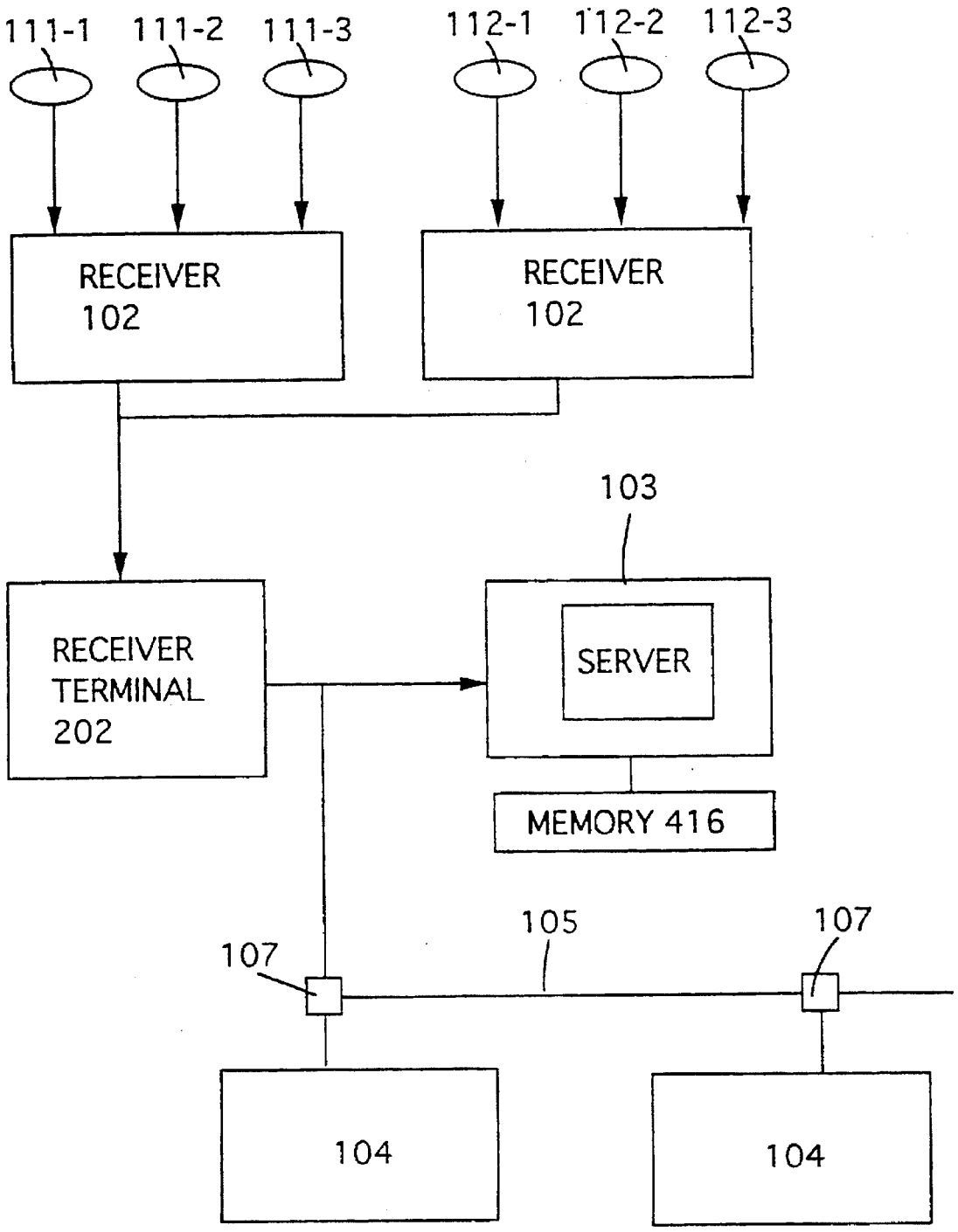
FIG. 7 shows a fire alarm system according to a fourth embodiment of the present invention.

FIG. 7 shows a fourth embodiment of the present invention. This is similar to the second embodiment shown in FIG. 5.

In this fourth embodiment an external memory 416 is connected to the controller 103. Memory 416 stores the code numbers of registered tunes still to be played at the time a fire or emergency is detected, the code numbers being retrieved from memory 137. The operation of the fire alarm system according to this fourth embodiment will be described below with reference to FIG. 8.

Figure 4A:
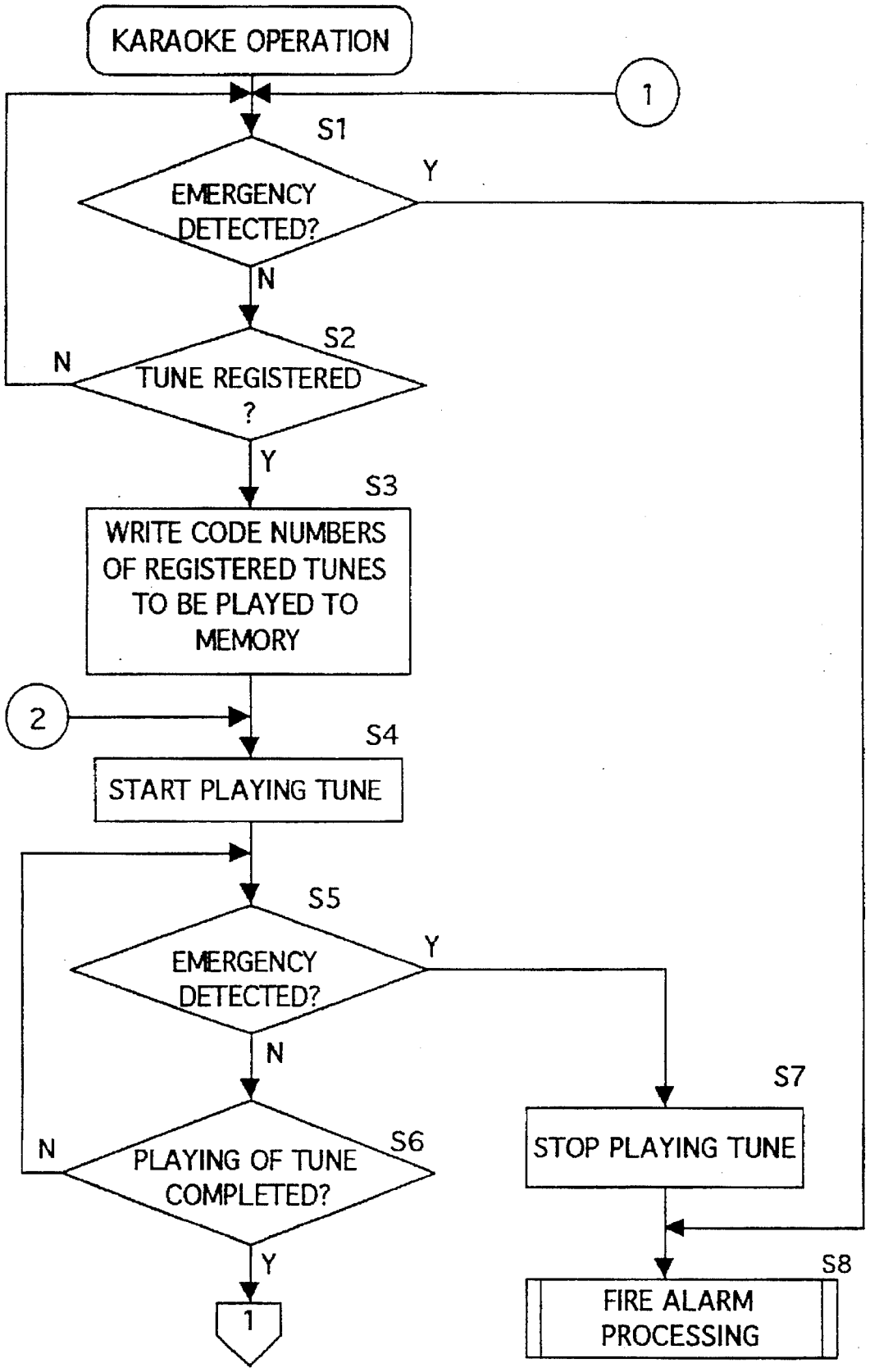
FIGS. 4A and 4B show a flowchart of an operation of the fire alarm system shown in FIG. 1.
Figure 4B:
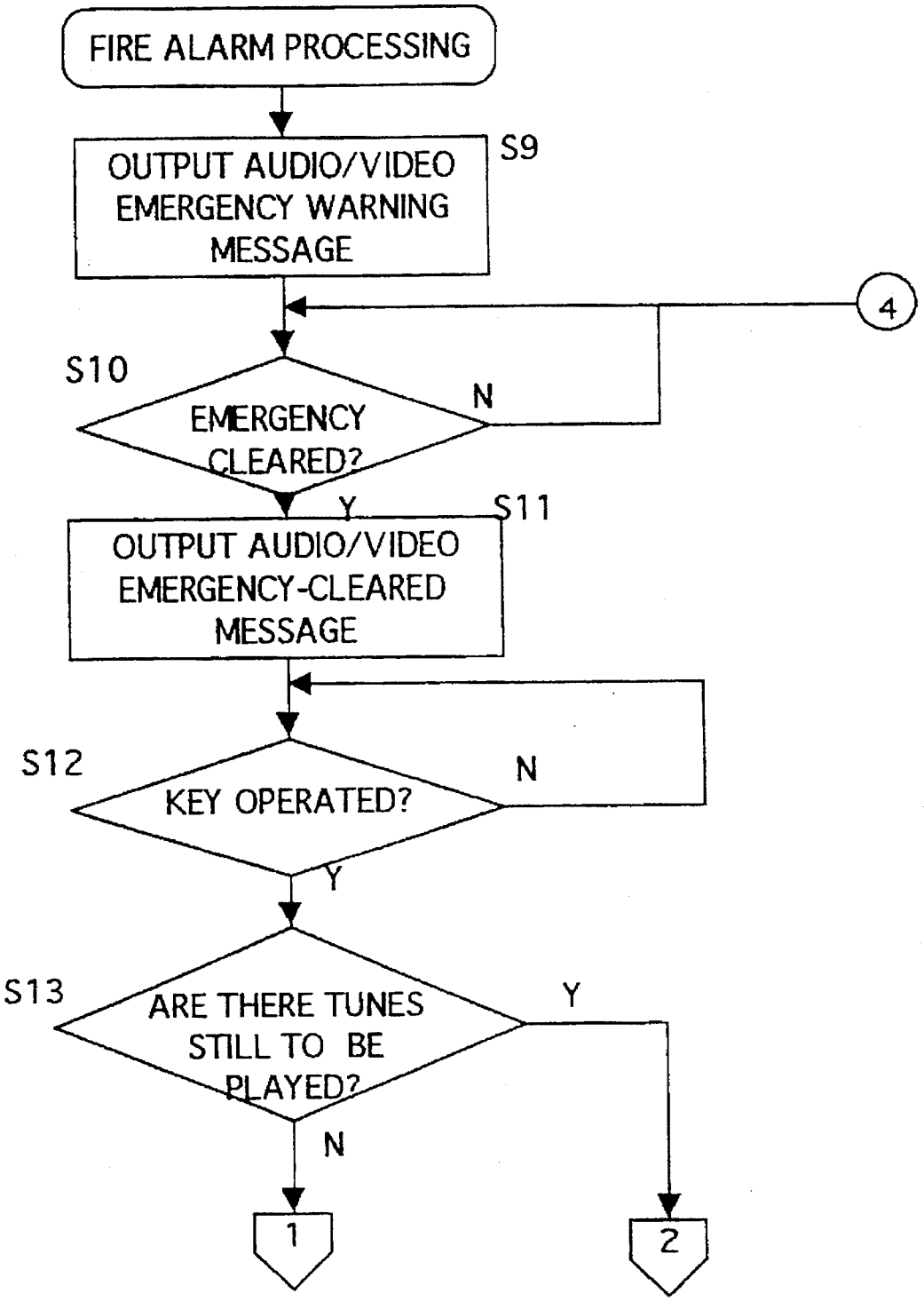

The initial operation of the fire alarm and karaoke system is similar to steps S1 through S7 shown in FIG. 4A and described above for the first embodiment. However, the fire alarm processing is different than that shown in FIG. 4B.

Figure 8:
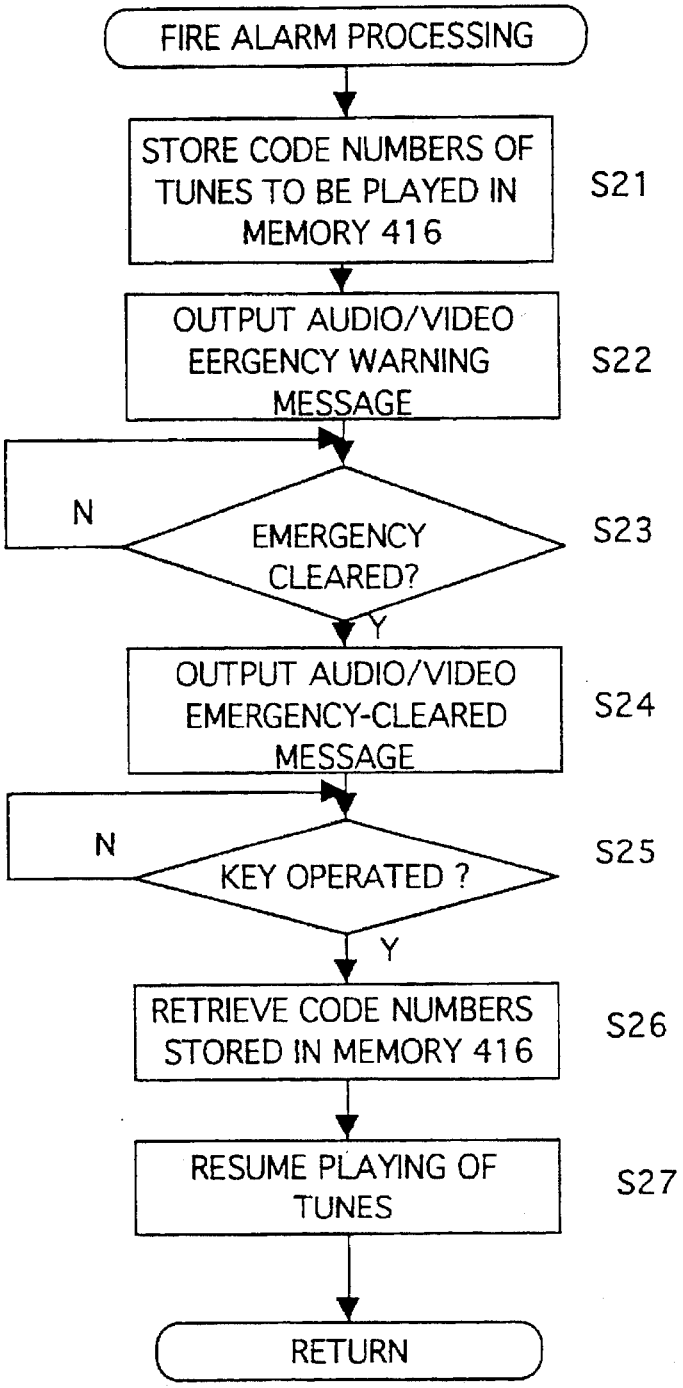
FIG. 8 shows a flowchart of an operation of the fire alarm system shown in FIG. 7.

As shown in FIG. 8, at the initial step S21 of the fire alarm processing the code numbers of the tunes still to be played are retrieved from the memory 137 and stored in memory 416. Then the controller performs steps S22 through S25. In step S22, the emergency audio and video information is sent to the speakers 110 and display 109, then the controller 103 waits for the emergency to be cleared and the restart key to be operated in steps S23 through S25.

After the reset key has been operated in step S25, the code numbers of the tunes still to be played that are stored in the memory 416 are retrieved by controller 103 and stored in the memory 137, in step S26. Then the audio data corresponding to the stored tunes is sent to the karaoke terminal in step S27, as described before.

A fire alarm system according to a fifth embodiment of the present invention will be described below.

Figure 9:
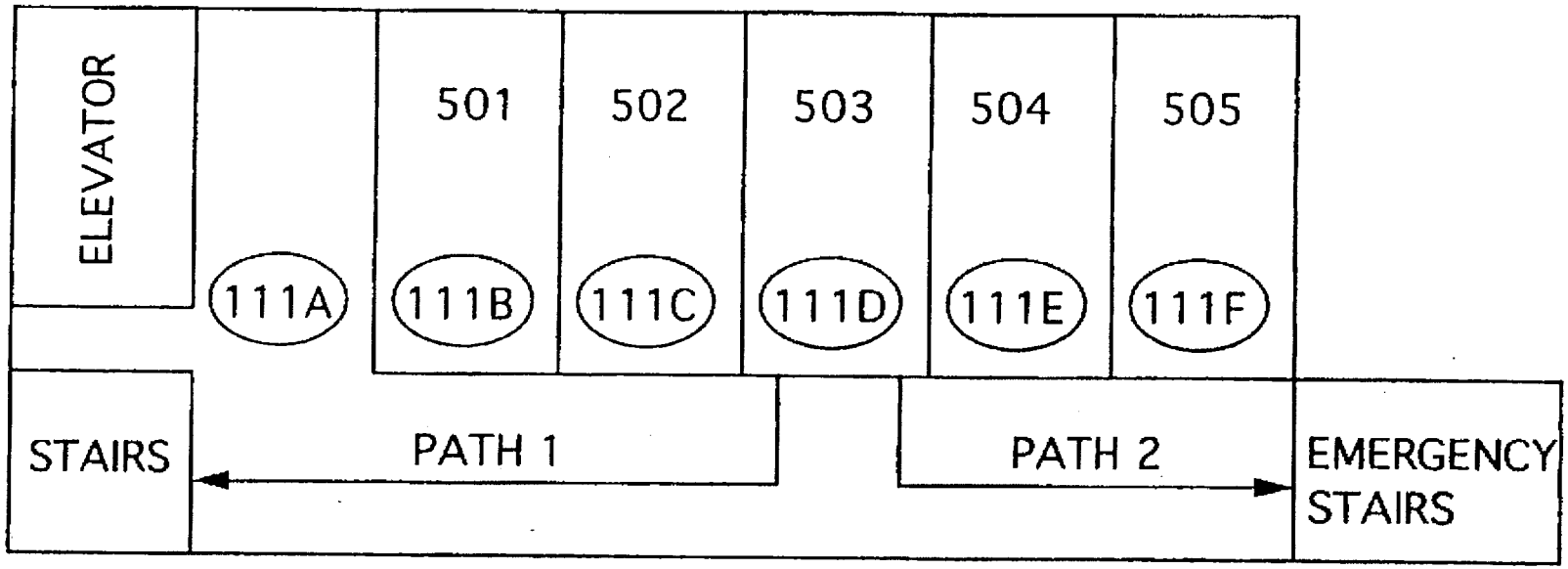
FIG. 9 shows a relationship between exit paths from various karaoke rooms and fire sensors, according to the fifth embodiment of the present invention.

Configuration of the fifth embodiment is similar to that shown in FIG. 1. The karaoke system according to the fifth embodiment is provided with a plurality of karaoke rooms arranged as shown in FIG. 9. If one of sensors 111A through 111F detects the fire, it sends the detection signal to the receiver 102. The receiver 102 sends a predetermined signal to the controller 103 upon reception of the detection signal. The controller 103 locates the area where the fire broke out according to the signal, and further determines optimum paths to the emergency exits for respective karaoke rooms. The controller 103, then sends information related to the located area and the paths to the exits, to the respective karaoke terminals 104. The karaoke terminal 104 displays the area where the fire broke out, and the path to the emergency exit that should be taken.

FIG. 9 shows the arrangement of the rooms 501 through 505, and the sensors 111A through 111F, and the exit paths. At the alley in front of an elevator, sensor 111A is provided. In rooms 501 through 505, sensors 111B through 111F are provided. In accordance with the area where the fire broke out, i.e., in accordance with the sensor which detected the fire, the stairs or emergency stairs are selected. In FIG. 9, path 1 from room 503 to the stairs, or path 2 from the room 503 to the emergency stairs are determined in accordance with the area where the fire broke out.

Figure 10:
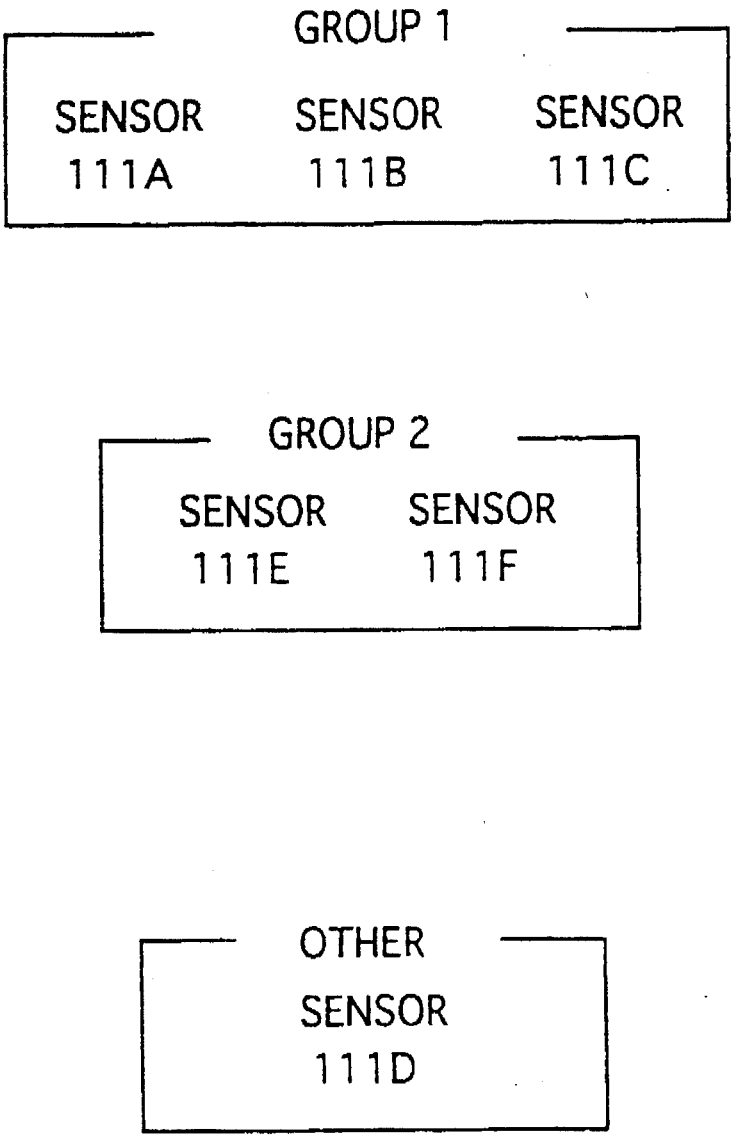
FIG. 10 shows a grouping of sensors.

FIG. 10 shows a grouping of the sensors 111A through 111F with respect to room 503. The sensors 111A through 111F are divided into three groups: a first group is a group adjacent to path 1 consisting of sensors 111A through 111C; a second group is a group adjacent to path 2 consisting of sensors 111E and 111F; and a third group is a group consisting of a sensor which does not belong to either group 1 or group 2, i.e., the sensor 111D. This grouping of the sensors are made for each room, and stored in the controller 103 as a data table. Table 1 is a model of such a table. If fire broke out, the controller 103 determines the optimum path with respect to each room in accordance with the data shown in Table 1, and have the display 109 show the map of the emergency exit.

TABLE 1

| Room No. | Group NO. | Adjacent sensor No. |
|---|---|---|
| 501 | Path 1 | 111A, |
| | Path 2 | 111C, 111D, 111E, 111F |
| | Other | 111B |
| 502 | Path 1 | 111A, 111B |
| | Path 2 | 111D, 111E, 111F |
| | Other | 111C |
| 503 | Path 1 | 111A, 111B, 111C |
| | Path 2 | 111E, 111F |
| | Other | 111D |
| 504 | Path 1 | 111A, 111B, 111C, 111D |
| | Path 2 | 111F |
| | Other | 111E |
| 505 | Path 1 | 111A, 111B, 111C, 111D, 111E |
| | Path 2 | |
| | Other | 111F |

Figure 11A:
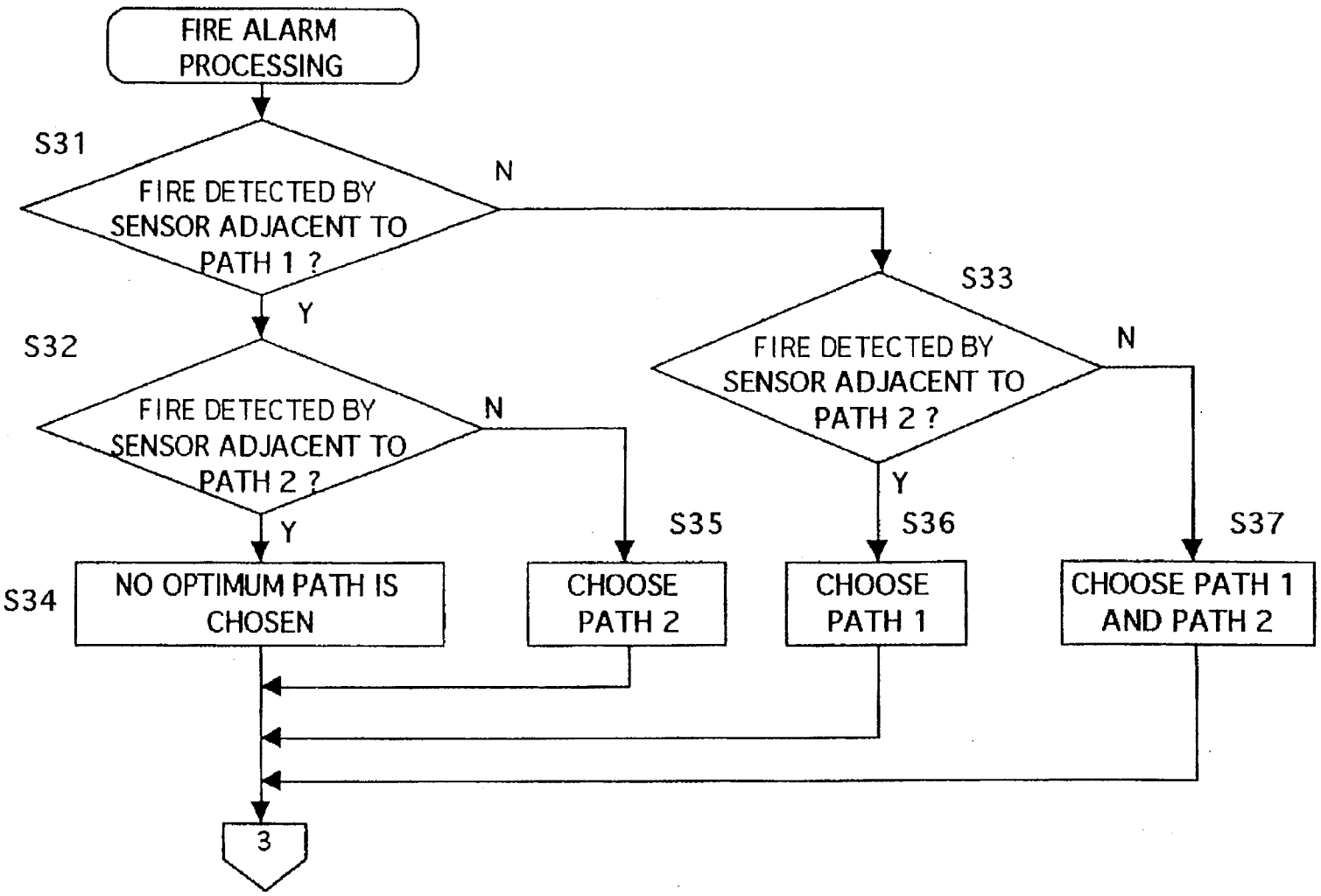
FIGS. 11A and 11B show a flowchart of a fire alarm processing of a fire alarm system according to a fifth embodiment of the present invention.
Figure 11B:
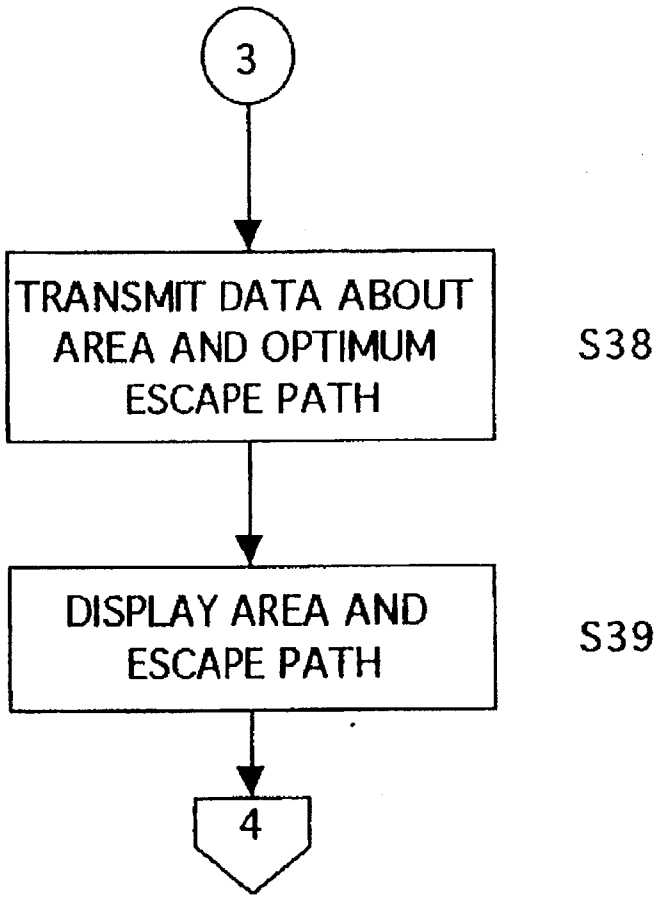

An operation of the fire alarm processing performed by this fire alarm system will be described below with reference to FIGS. 11A and 11B.

First, it is determined whether the sensor(s) which detected the fire is in the first group or second group, in step S31. If the sensor in the first group detects the fire (S31:YES), and the sensor in the second group did not detect the fire (S32:NO), the path 2 is selected as the optimum path in step S35. If only the sensor(s) included in the second group detected the fire (S31:NO; S33:YES), the path 1 is selected as the optimum path in step S36. If the sensor which detected the fire is not in the first or second group (S31:NO; S33:NO), both paths 1 and 2 are selected in step S37. Then the chosen optimum path(s) is displayed on the display 109 in steps S38, S39.

Then control goes to step S38, where the data about the area and optimum path is transmitted from the controller 103 to the karaoke terminal 104 in each of the karaoke rooms 501 through 505. The memory 137 of the karaoke terminal 104 also includes video information representative of the physical layout of the building housing the karaoke rooms 501 through 505. Then in step 39, the area and escape route are displayed on the display 109. Further, an audio alarm message is sent from the memory 137 to the audio speakers 110, in a similar manner as described for the first embodiment. Then control goes to step S9 as shown in FIG. 4B, and continues as described for the first embodiment above. If the sensors belong to both the first and second groups, then the optimum path cannot be selected as the step S34). In this case, all of the areas where the fire broke out are displayed together with a message stating that the situation is dangerous, and should evacuate carefully.

For example, control for room 501 proceeds as explained below. If the fire broke out in room 502, then the sensor 111C outputs the detection signal. As shown in Table 1, the sensor 111C is included in the second group. Therefore, the path 1 is selected as the optimum path.

For room 502, since the sensor 111C is included in the other group, the path 1 and the path 2 are selected as the optimum paths.

For room 503, since the sensor 111C is included in the first group, and accordingly the path 2 is selected as the optimum path.

Figure 12:
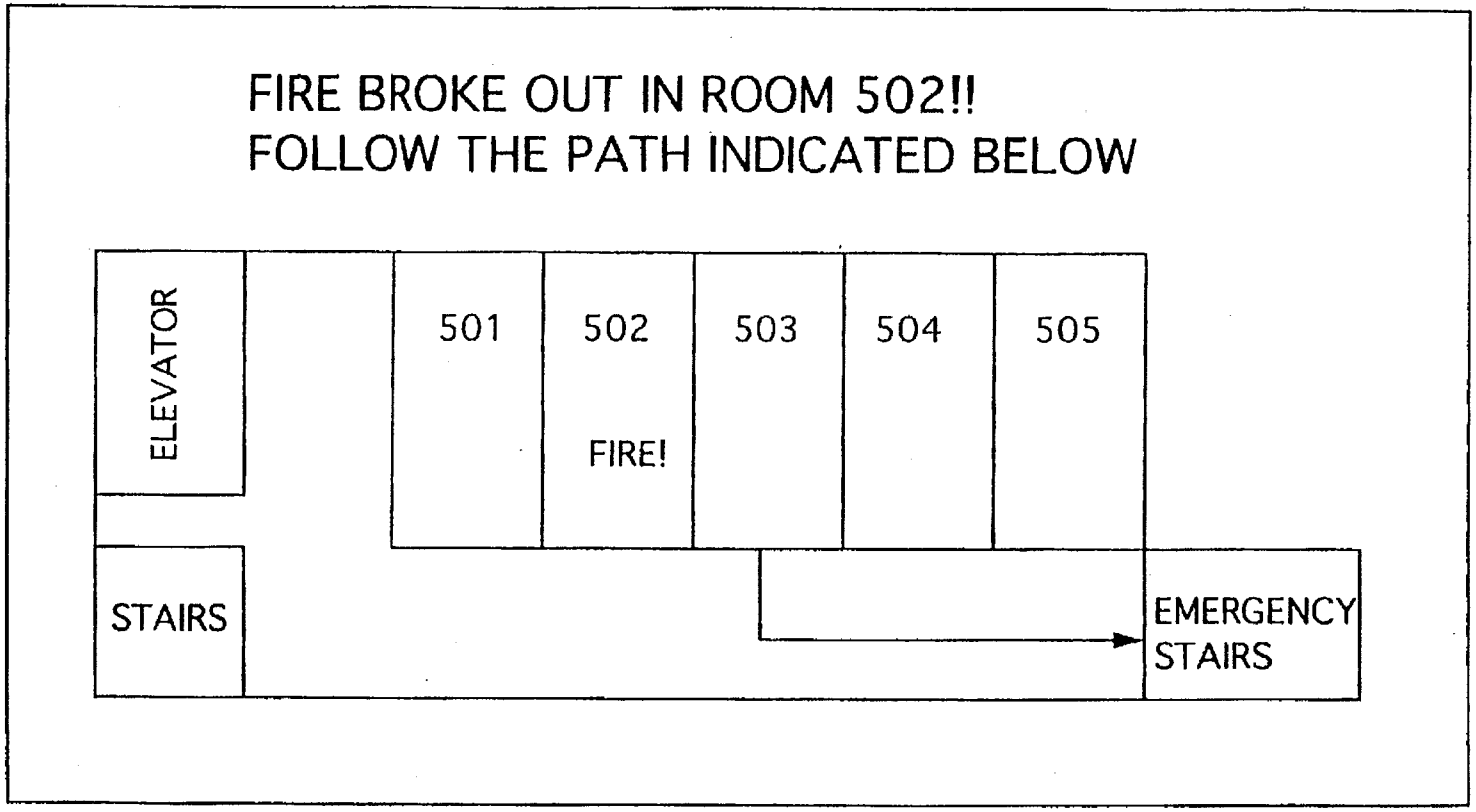
FIG. 12 shows an example of a screen display according to the fifth embodiment of the present invention.

FIG. 12 shows an example of a screen image displayed on display 109, according to this fifth embodiment. In this example, a fire broke out in karaoke room 502. Sensor group 111C outputs a signal indicating that a fire has been detected. Accordingly, for room 503, as shown in Table 1, sensor 111C is adjacent to path 1, therefore, path 2 will be selected as the optimum path. This is shown on the display 109 along with a message stating: FIRE BROKE OUT IN ROOM 502ii FOLLOW THE PATH INDICATED BELOW.

As described above, this fifth embodiment also includes information of the display 109 about the physical layout of the floor of the building in which the karaoke rooms are located, and the best path to take should a fire break out in one of the rooms.

Figure 13:
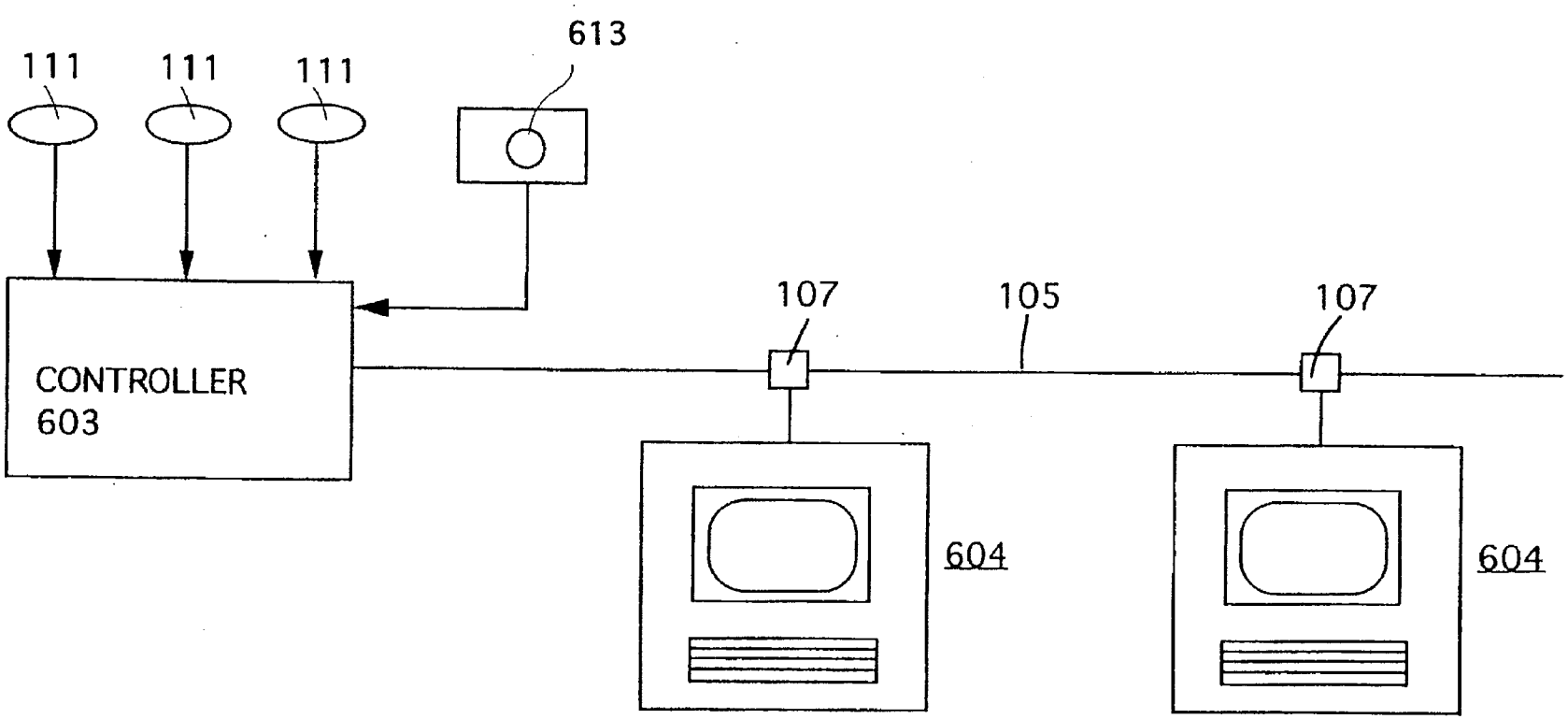
FIG. 13 shows a fire alarm system according to a sixth embodiment of the present invention.

FIG. 13 shows a fire alarm system according to a sixth embodiment of the present invention. The fire alarm system is similar to the first embodiment shown in FIG. 1 and includes sensors 111, a fire alarm button 613, a controller 603 and video game machines 604. When the alarm button (not shown) is pressed a predetermined alarm actuation signal is sent to the controller 603. When the controller 603 receives the predetermined alarm actuation signal, a fire alarm signal is sent to each of the video game machines 604. Each video game machine 604 can indicate to a user that there is a fire in the immediate area, and that the user should vacate the area.

Figure 14:
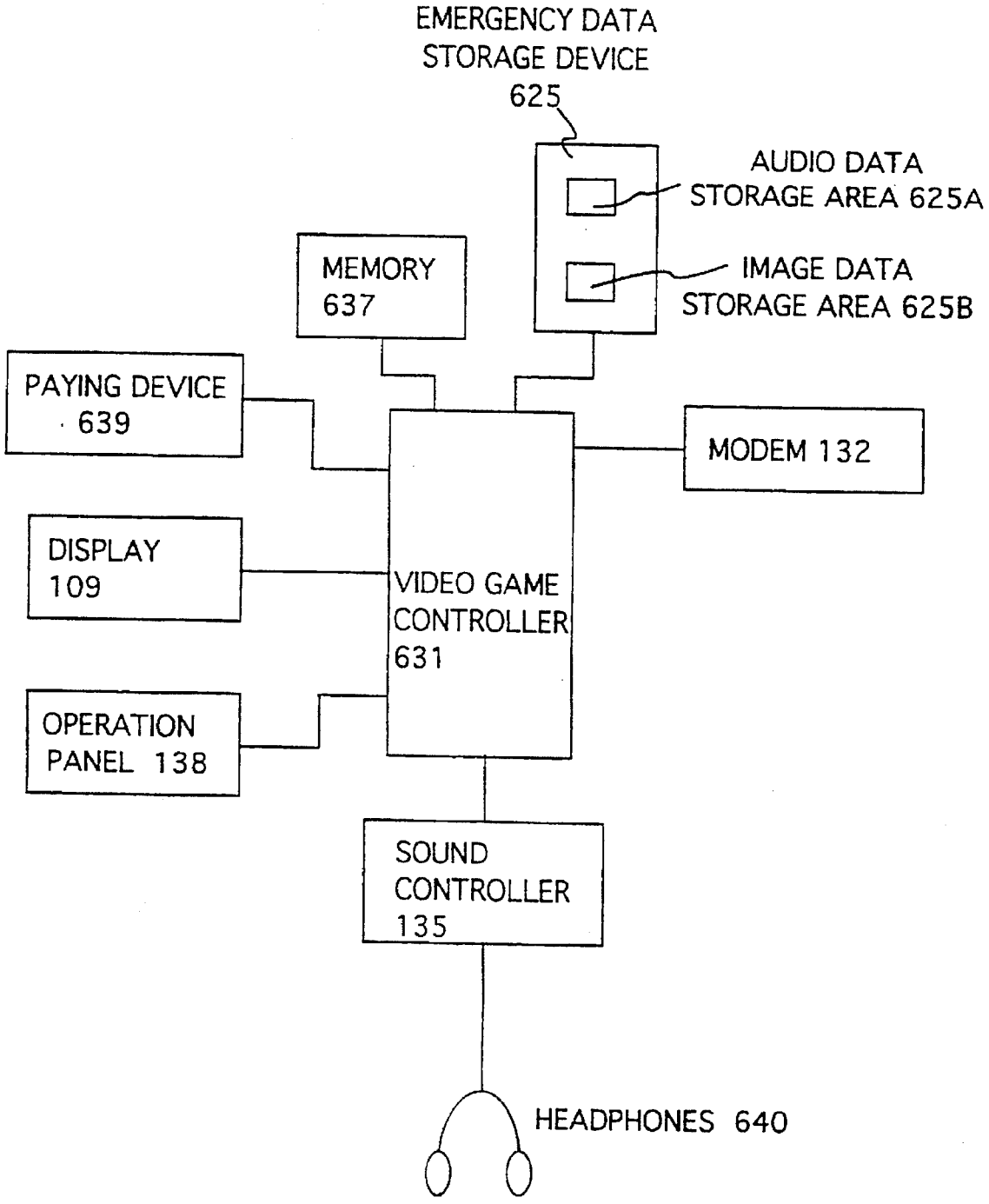
FIG. 14 shows a block diagram of a video game machine used with the fire alarm system shown in FIG. 12.

FIG. 14 shows a block diagram of one of the video game machines 604.

Initially money is placed in the paying device 639 of the video game machine 604 in order to start the video game. Once the money is received the display prompts the user to put on the headphones 640 if required, and then to press a start button on the operation panel 138. Further, an audio menu is transmitted to the headphones 640 to instruct the user on how to operate the video game machine 604. The data for the audio menu is also stored in the memory 637. The data is retrieved from the memory 637 by a video game controller 631 and then converted to an analog signal by a sound controller 135, and then outputted to the headphones 640.

The digital data is stored in the memory 637 as MIDI (musical instrument digital interface) data. The MIDI data is read by the video game controller 631 and also output sound controller 135 where a sound signal which corresponds to the MIDI data is generated and transmitted to the headphones 640.

Video game machine 604 also includes an emergency data storage device 625 and a modem 132. If a fire has been detected by the sensors 111, controller 603 sends the fire alarm signal to video game controller 631 in the video game machine 604 via a cable 105, patch unit 107 and modem 132. The emergency data storage device 625 stores audio data in storage area 625A and image data in storage area 625B.

Figure 15:
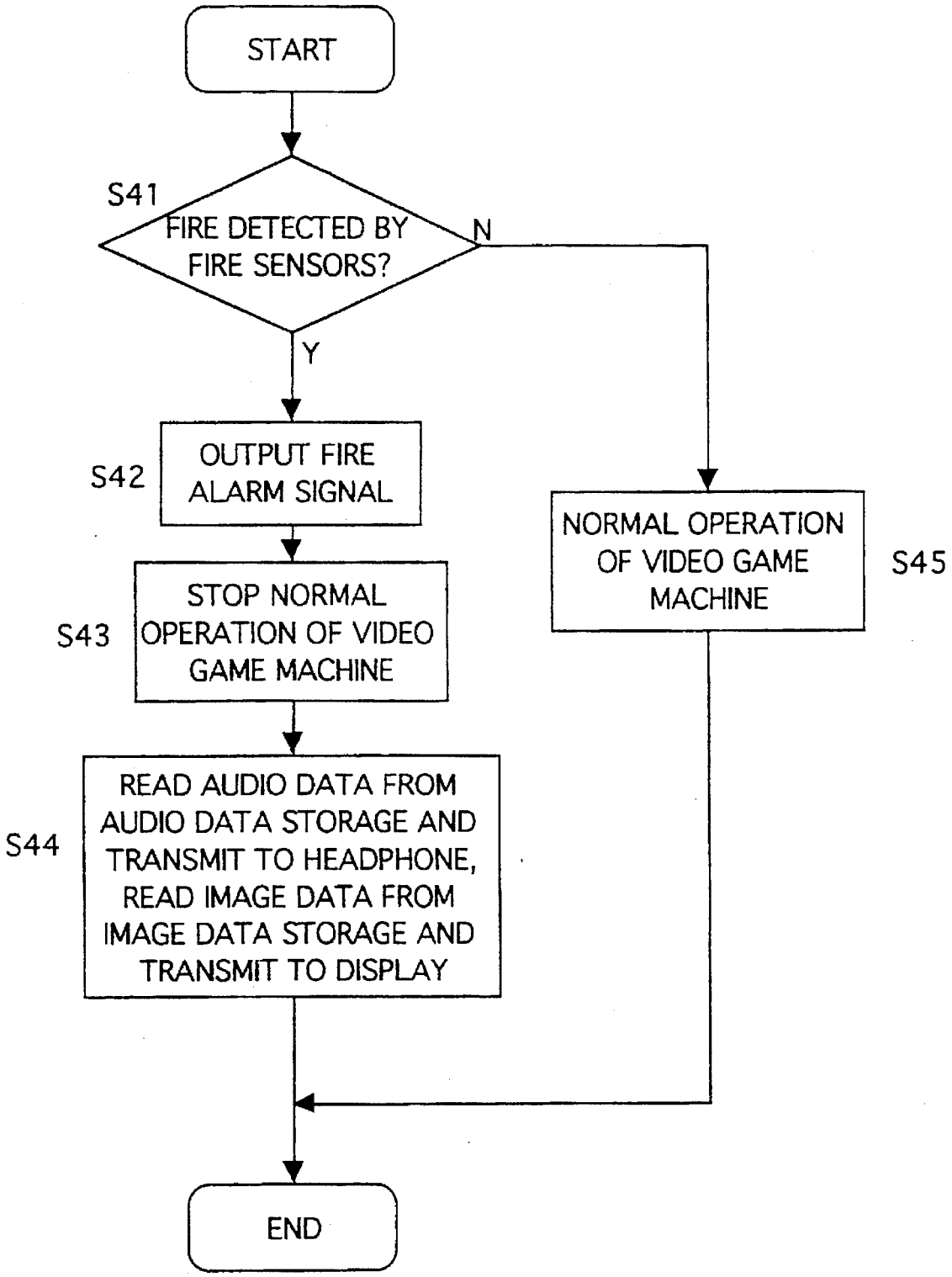
FIG. 15 is a flowchart showing an operation of the fire alarm system shown in FIG. 12.
Figure 16:
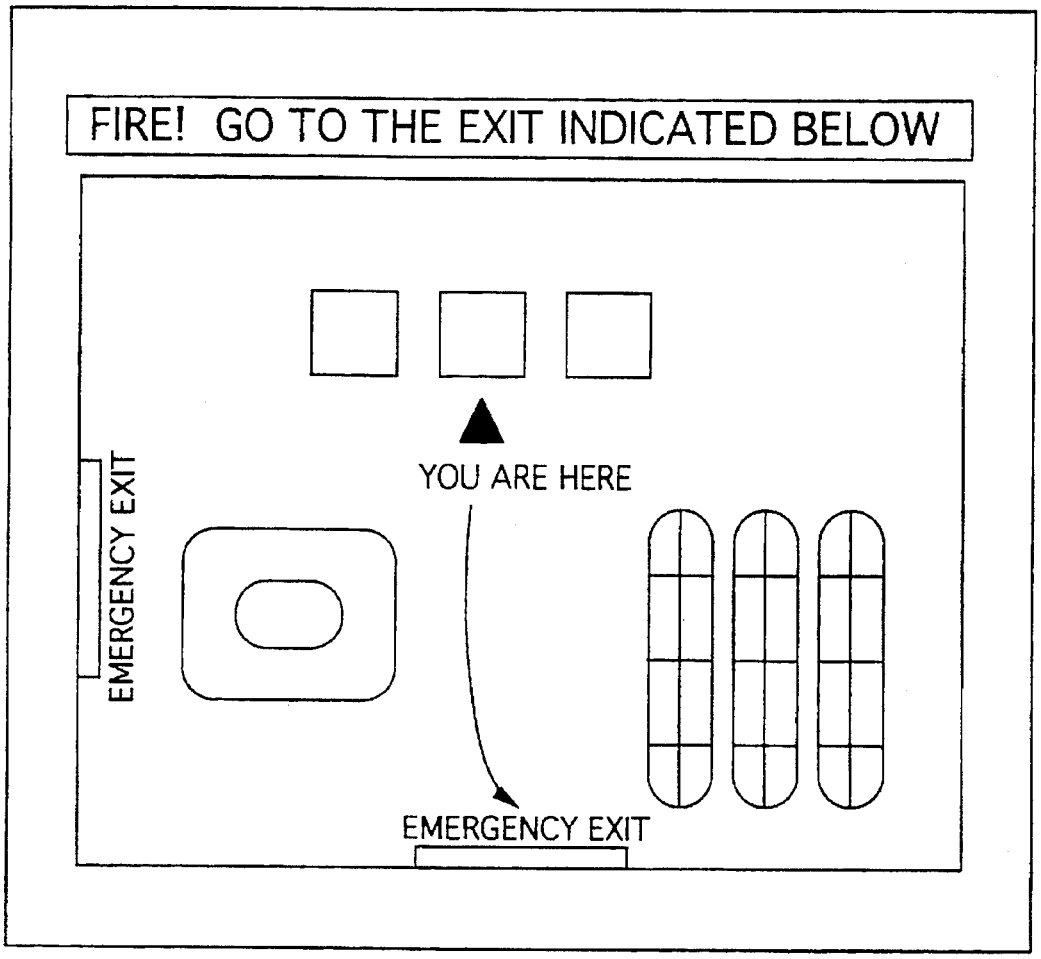
FIG. 16 shows a screen image of a display on the video game machine shown in FIG. 13 when a fire alarm is actuated.

The operation of the fire alarm system embodying the present invention will be described below with reference to FIG. 15.

When a fire is detected by the sensors 111 or the fire alarm button 613 is depressed in step S41, the controller 603 outputs the fire alarm signal in step S42. If no fire is detected, normal operation of the video game machine 604 is continued in step S45.

The video game controller 631 receives the fire alarm signal from controller 603 through modem 132 and stops normal operation of the video game machine 604, in step S43. Then in step S44, the emergency audio data is read from the audio data storage area 625A of the emergency data storage device 625, converted from digital to analog data by sound controller 135, and transmitted to the headphones 640. Simultaneously, the emergency image data is read from the image data storage area 625B of the emergency data storage device 625, and is transmitted to the display 109. Then the control sequence is ended.

FIG. 17 shows an image seen on a screen of display 109. Near the top of the screen a warning message "FIRE! GO TO THE EXIT INDICATED BELOW" is displayed. This alerts the user to the danger of a fire. Below the warning message the screen image displays a map of the enclosed environment. The map shows the user where he is and indicates the emergency exits and the route to the nearest emergency exit.

Figure 18:
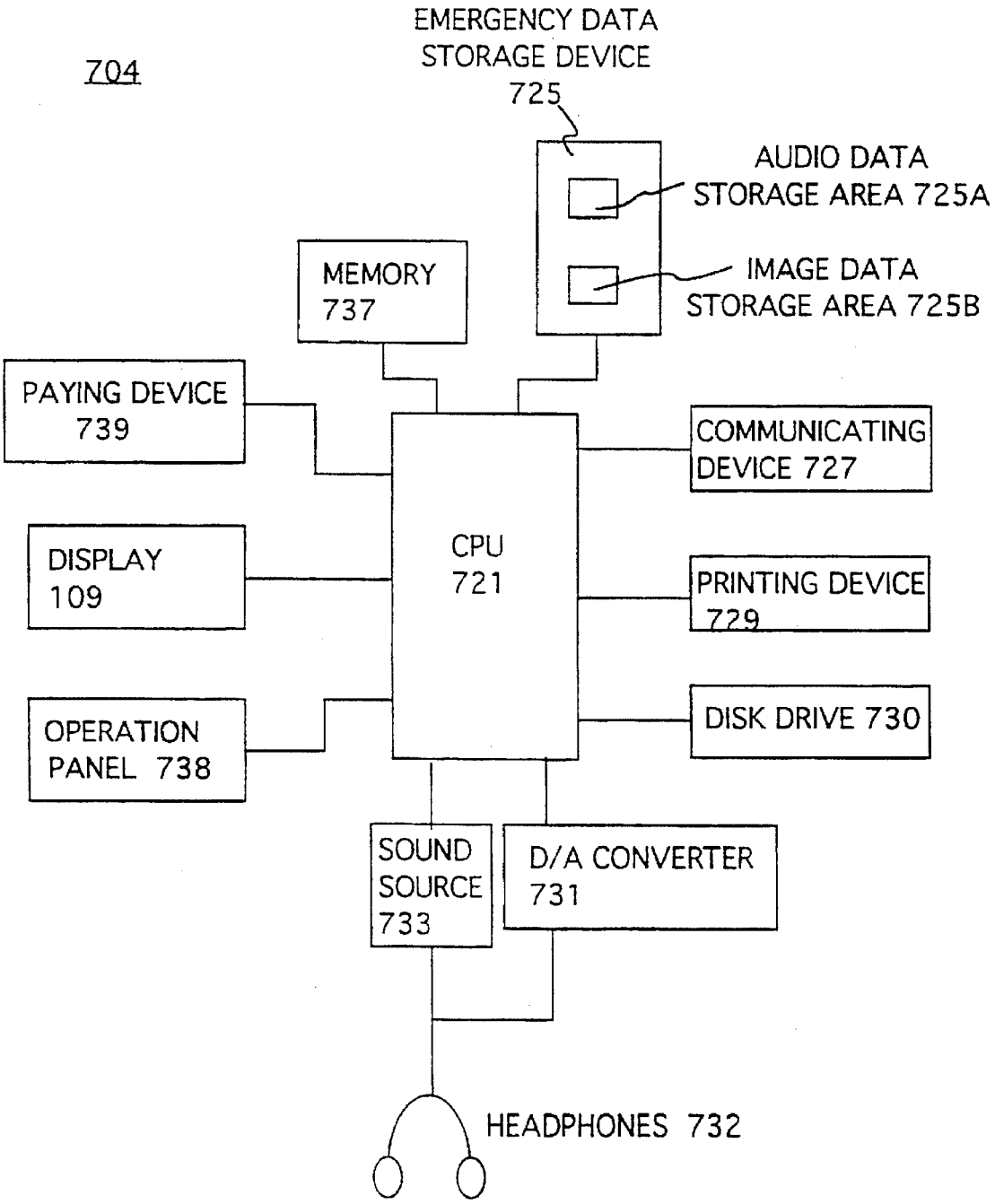
FIG. 18 is a block diagram of a vending machine according to a seventh embodiment.

FIG. 18 shows a block diagram of a vending machine 704 according to a seventh embodiment of the invention. Configuration of the alarm system is similar to that of the six embodiment.

In the seventh embodiment, the vending machine 704 sells sheet music and digital music data. The sheet music is printed on paper by a printing device 729, and the digital music is stored on a floppy disk inserted into the disk drive 730.

Initially a menu of the available tunes is displayed on the display 109. The user chooses the tune that he wishes to hear by using the operation panel 735. The image data for displaying the menu and the tune names is stored in the memory 737. Once the tune is selected, the display prompts the user to put on the headphones 732 in order to hear the tune. Further, an audio menu is transmitted to the headphones 732 to instruct the user on how to operate the vending machine 704. The data for the audio menu is also stored in the memory 737. The data is retrieved from the memory 737 by a CPU 721 and then converted to an analog signal by a D/A converter 731, and then outputted to the headphone 732.

The digital data is stored in the memory 737 as MIDI (musical instrument digital interface) data. The MIDI data is read by the CPU 721 and output to sound source 733 where a sound signal which corresponds to the MIDI data is generated and transmitted to the headphones 732.

When the user has determined the tune which he wishes to purchase, the menu allows him to choose to print the sheet music or record the digital data onto a floppy disk. Further the price of the transaction in displayed in the paying device 739. In this embodiment, the paying device 739 uses prepaid debit cards, and subtracts units of money from the card in order when a purchase is made. However, it is possible to use a different type of paying device which uses a credit card or cash.

After payment has been received the vending machine will print the sheet music or store the data onto a floppy disk in accordance with the decision made by the user. The printing device prints an image onto a recording medium such as paper which includes the musical score and related information. The disk drive 730 records the MIDI data onto a floppy disk (not shown) so that the disk may be used by instruments such as electronic pianos or synthesizers.

Vending machine 704 also includes an emergency data storage device 725 and a communicating device 727. If a fire has been detected and the fire alarm signal is transmitted to the CPU 721 in the vending machine 704 via a communicating device 727, a message indicating the emergency is displayed on the display 109, and audio message is also provided to the user through the headphone 732. In the vending machine 704, the storage device 725 stores audio data in storage area 725A and image data in storage area 725B.

According to the present invention, a person in an enclosed environment using an interactive device such as a video game machine, can be alerted to the danger of a fire even if the person cannot hear a conventional fire alarm since the person is wearing a headphone. By transmitting an audible alarm message and a visual message, the person is quickly informed about the danger of a fire.

The present invention is not limited to the embodiment described above, but can be modified in various way. For instance, a cable linking the controller 603 and the sensors 111 can be replaced with a wireless link. Similarly, a wireless link may be employed between controller 603 and modem 132. Further, the function of the controller 603 could be incorporated into the video game machine 604, such that only the sensors 111 are required for sensing a fire.

It is also possible to modify the embodiment such that the display 109 is turned off and a buzzer is activated in the headphones 640. This would simplify the control and construction of the video game machine while still providing a method of alerting the user to possible danger. Further, it is possible to have the display and audible alarm message change depending on whether the sensors 111 sensed the fire, or whether the fire alarm button 613 was activated.

Thus, as shown in the six embodiments above, if a person is using an interactive machine such as a karaoke terminal or video game machine and an emergency such as a fire occurs, the fire alarm of the present invention, sends a warning message to the person by using the interactive machine as the message sending medium. Therefore, even if the person cannot hear or see warnings from an external source such as a siren, the person will still be informed of the emergency situation.

What is claimed is:

1. An information providing system, comprising:

a first controller;

means for storing information to be provided;

means for transmitting a predetermined signal carrying said information to be provided;

a plurality of terminal devices, each of said plurality of terminal devices having:

(1) at least one of audio information indication means and image information indication means;

(2) means for receiving said predetermined signal; and (3) a second controller for controlling said at least one of said audio information indication means and image information indication means to indicate a predetermined information to an operator in accordance with said predetermined signal received by said signal receiving means; and emergency detecting means connected to said first controller for detecting an emergency condition and sending an emergency detection signal to said first controller, wherein said first controller controls said transmitting means to transmit an emergency information signal to said signal receiving means of each of said plurality of terminal devices in response to said emergency detection signal sent by said emergency detecting means, and wherein said second controller of each of said plurality of terminal devices controls said at least one of audio information indication means and image information indication means to stop providing said predetermined information and to provide said emergency information, which indicates said emergency condition, to said operator in response to said emergency information signal received by said signal receiving means.

2. The information providing system according to claim 1, wherein said emergency detection signal contains information of an outbreak of a fire.

3. The information providing system according to claim 1, wherein each of said terminal devices is operated in an enclosed circumstance.

4. The information providing system according to claim 1, wherein said emergency information includes an indication of a passageway.

5. The information providing system according to claim 4, wherein said indication of a passageway is a visual indication.

6. The information providing system according to claim 5, wherein said visual indication includes a message.

7. The information providing system according to claim 5, wherein said visual indication includes a map showing said passageway.

8. The information providing system according to claim 1, wherein said emergency detecting means comprises a plurality of sensors for detecting an outbreak of a fire and outputting a fire detection signal, and a receiver for receiving said fire detection signal from respective sensors and for sending said emergency detection signal to said first controller.

9. The information providing system according to claim 1, wherein said first controller is capable of controlling said transmitting means to output an emergency-cleared information signal to said receiving means when said emergency condition is cleared, and wherein said second controller controls said at least one of audio information indication means and image information indication means to stop providing said emergency information when said receiving means has received said emergency-cleared information signal.

10. The information providing system according to claim 9, wherein said second controller controls said at least one of said audio information indication means and image information indication means to provide information indicating said emergency condition is cleared when said receiving means receives said emergency-cleared information signal.

11. The information providing system according to claim 9, wherein said second controller controls said at least one of audio information indication means and image information indication means to start providing said predetermined information when said receiving means has received said emergency-cleared information signal.

12. The information providing system according to claim 10, wherein said second controller controls said at least one of audio information indication means and image information indication means to start providing said predetermined information automatically when said receiving means has received said emergency-cleared information signal.

13. The information providing system according to claim 10, wherein said second controller controls said at least one of audio information indication means and image information indication means to start providing said predetermined information when said operator executes a predetermined operation with said terminal device.

14. The information providing system according to claim 10, wherein said second controller of each terminal device comprises a memory for storing operation condition information when said receiving means received said emergency information signal and said second controller controls said at least one of said audio information indication means and image information indication means to stop providing said predetermined information, said operation condition information stored in said memory can be used when said information providing operation is restarted.

15. The information providing system according to claim 1, wherein said predetermined information comprises entertainment information.

16. The information providing system according to claim 9, wherein said audio information indication means comprises a music reproducing device.

17. An information providing system, comprising:

a controller;

a plurality of terminal devices connected to said controller, said controller controlling each of said plurality of terminal devices to provide a predetermined information to an operator, each of said terminal devices having a plurality of information indication means including an audio information indication means and an image information indication means;

emergency detecting means for detecting an emergency condition and outputting a predetermined signal to said controller;

wherein said controller controls each of said plurality of terminal devices to stop providing said predetermined information and provide an emergency information indicating said emergency condition to an operator by means of at least one of said plurality of information indicating means in response to said predetermined signal transmitted from said controller.

18. The information providing system according to claim 17, wherein said controller comprises means for transmitting information to be provided to each one of said plurality of terminal devices.

19. The information providing system according to claim 18, wherein said information transmitted by said transmitting means includes said predetermined information.

20. The information providing system according to claim 19, wherein said information transmitted by said transmitting means includes said emergency information.

21. The information providing system according to claim 20, wherein said emergency information has an information of passageway.

22. The information providing system according to claim 21, wherein said controller is capable of determining optimum passageways for respective terminal devices.

23. The information providing system according to claim 22, wherein said emergency detecting means comprises a plurality of sensors for detecting outbreak of fire, wherein said controller comprises means for storing location of said plurality of sensors and location of said plurality of terminal devices, and wherein said controller determines said passageways for each terminal based on said location of said plurality of terminal devices and the location of a sensor which detects said outbreak of fire.

24. The information providing system according to claim 22, wherein said terminal devices respectively comprise display means for displaying image information, and wherein said passageways for respective terminals determined by said controller are displayed on said display means of respective terminal devices.

25. The information providing system according to claim 17, wherein said information providing system is for providing entertainment information.

26. The information providing system according to claim 17, wherein said terminal devices comprise a music reproducing device.

27. A combination of an alarm system and an information providing system, comprising:

a plurality of terminals for providing a predetermined information to respective operators, each of said terminals having a plurality of information providing devices;

emergency detecting means for detecting an emergency condition; and controller for controlling at least one of said information providing devices of each of said terminals currently used for providing said predetermined information to stop providing said predetermined information and provide an emergency information when said emergency detecting means detects said emergency condition.

* * * * *